United States Patent [19]

Johns et al.

[11] 4,047,408

[45] Sept. 13, 1977

[54] LOCK MECHANISM

[76] Inventors: Eddie D. Johns, 2680 SE. Spruce St., Hillsboro, Oreg. 97123; Robert E. Cummings, 45 Eagle Crest Drive, Lake Oswego, Oreg. 97034; Edgar W. Pearl, 18620 SW. Aloha Court, Aloha, Oreg. 97005

[21] Appl. No.: 638,609

[22] Filed: Dec. 8, 1975

[51] Int. Cl.[2] ..... E05B 65/06

[52] U.S. Cl. ..... 70/129; 70/149; 70/223

[58] Field of Search ..... 70/129, 124, 125, 128, 70/135, 145, 146 E, 146 H, 146 S, 188, 218, 221, 223, 231, DIG. 60, 149; 292/DIG. 27

[56] References Cited

U.S. PATENT DOCUMENTS

| | | | |
|---|---|---|---|
| 470,474 | 3/1892 | Colley | 70/129 |
| 592,606 | 10/1897 | Draullette | 70/149 X |
| 1,048,628 | 12/1912 | Woolsey | 70/129 |
| 1,447,754 | 3/1923 | Brabant | 70/223 |
| 2,497,328 | 2/1950 | Smith et al. | 70/149 X |
| 2,729,090 | 1/1956 | Floraday | 70/223 |
| 3,024,055 | 3/1962 | Novarino | 70/218 X |
| 3,896,644 | 7/1975 | Nagy et al. | 70/DIG. 60 X |

FOREIGN PATENT DOCUMENTS

| | | | |
|---|---|---|---|
| 88,287 | 12/1959 | Denmark | 70/DIG. 60 |
| 1,098,848 | 2/1961 | Germany | 70/129 |
| 312,499 | 7/1969 | Sweden | 70/223 |

*Primary Examiner*—Roy D. Frazier
*Assistant Examiner*—William E. Lyddane
*Attorney, Agent, or Firm*—Klarquist, Sparkman, Campbell, Leigh, Hall & Whinston

[57] ABSTRACT

A single cylinder deadbolt lock with a thumbturn includes a slidable pair of gear elements normally engaging the thumbturn with the cylinder whereby either one will operate the bolt. One such gear element is provided on a hub rotatable with the locking bar shaft, while the other gear element comprises part of the thumbturn mechanism. A rotatable sleeve coaxial with the locking bar shaft is also normally disposed in meshing engagement with the aforementioned hub but is restrained from axial movement. Axial movement together with rotation of the lock cylinder, e.g., for locking the mechanism, moves the hub and the sleeve out of meshing engagement, causing the hub and thumbturn to be held out of meshing engagement for disabling the thumbturn until the cylinder is again rotated.

13 Claims, 10 Drawing Figures

12
5
4
10
32
40
7
36
44
6
42
14
64
188
90
66
76
56
28
78
84
18
72
62
70
74
26
16
44
30
86
52
50
68
46
48
60
42
6
54
34
4
36
7
33
38
5
22
24
20

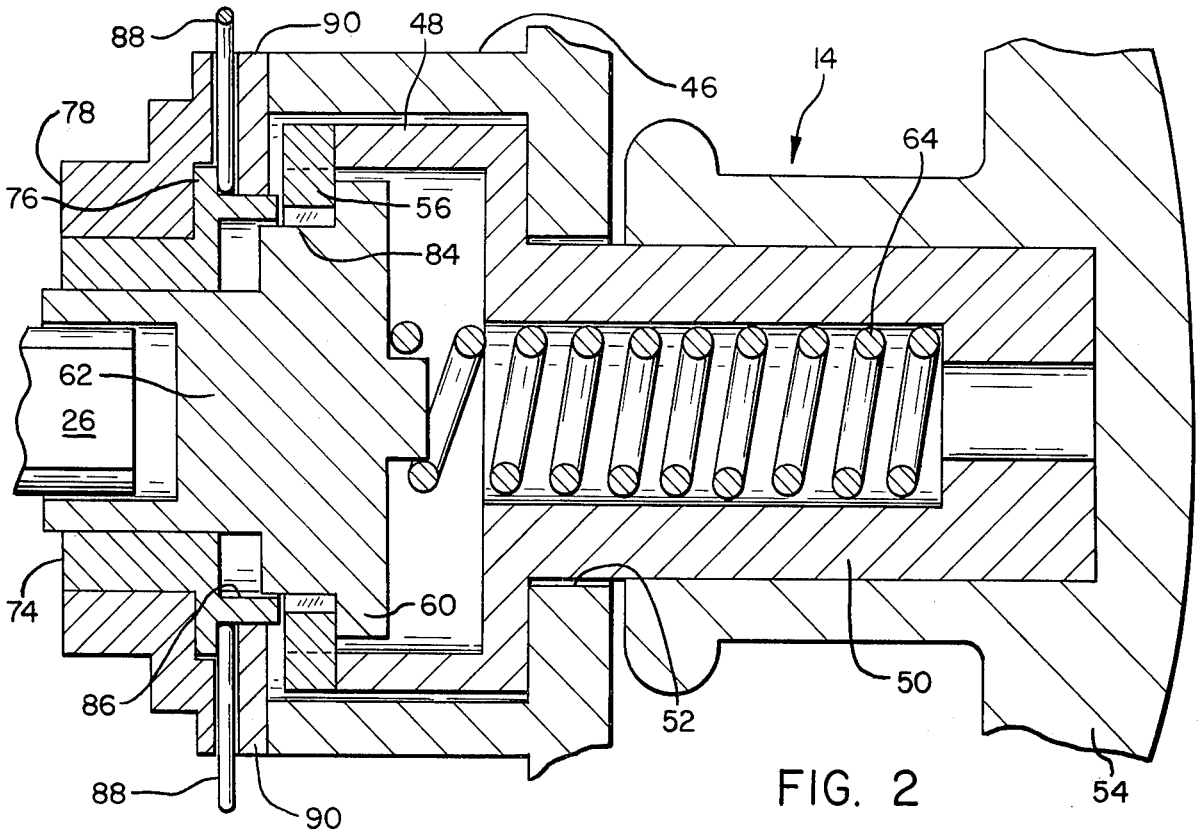
FIG. 2
FIG. 3
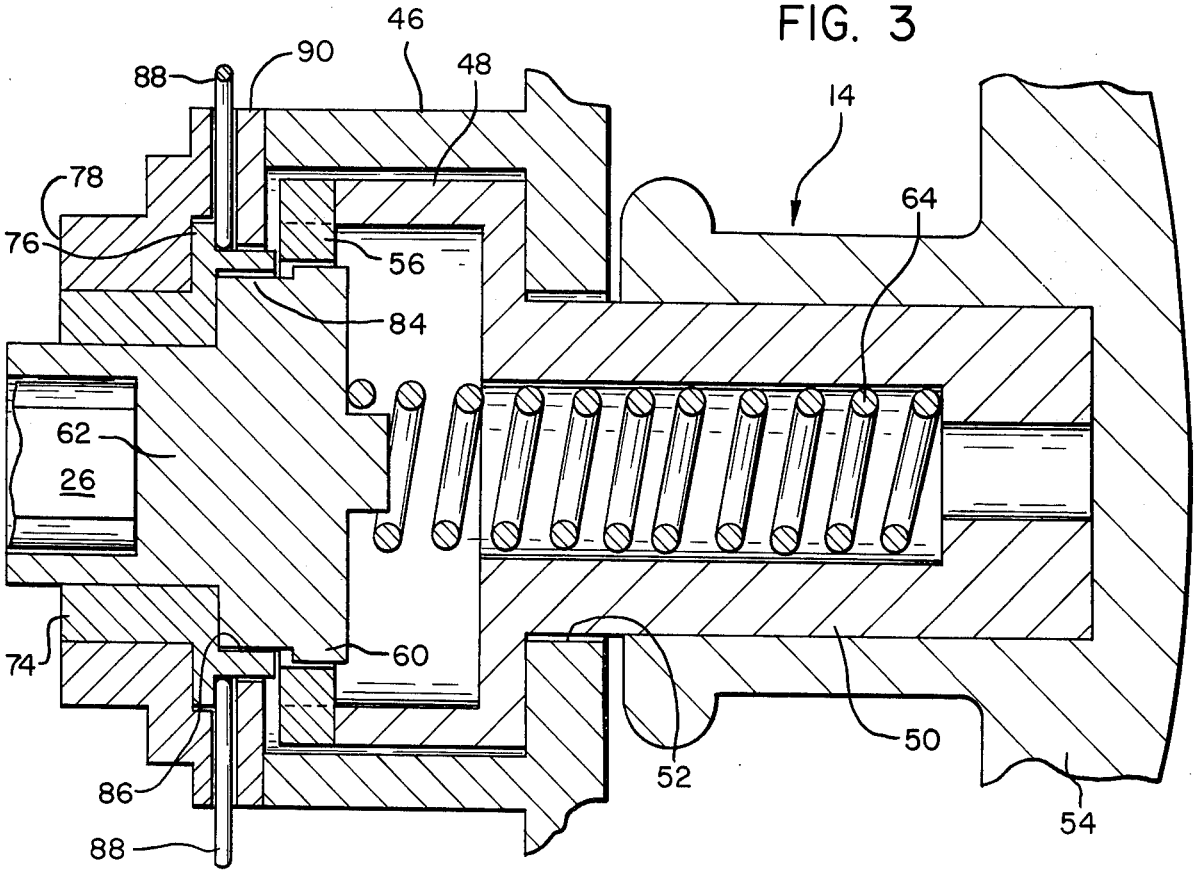

FIG. 4
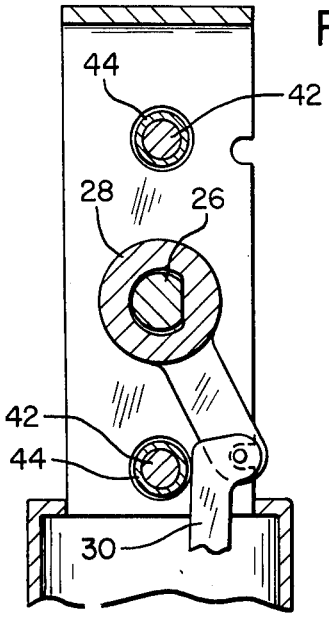
FIG. 5
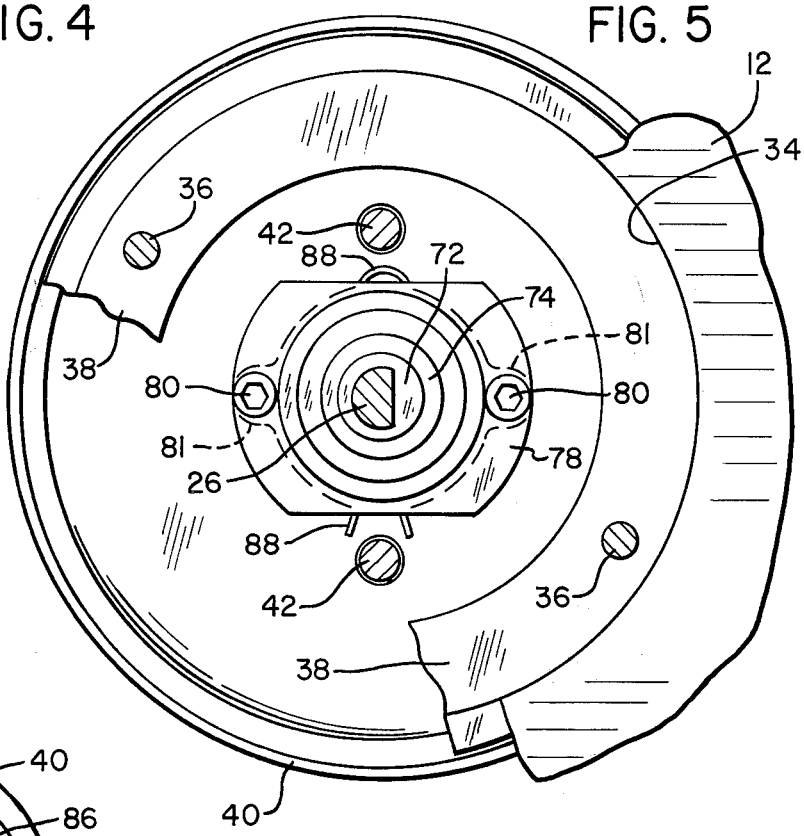
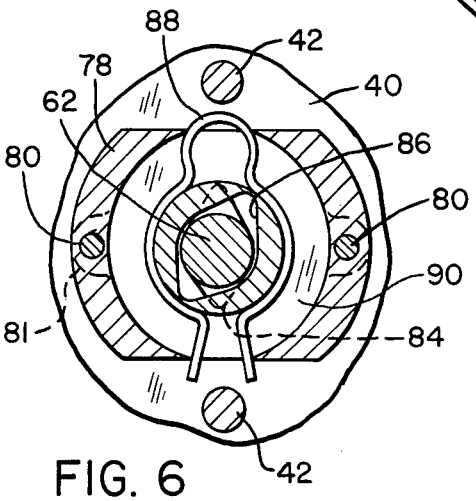
FIG. 6
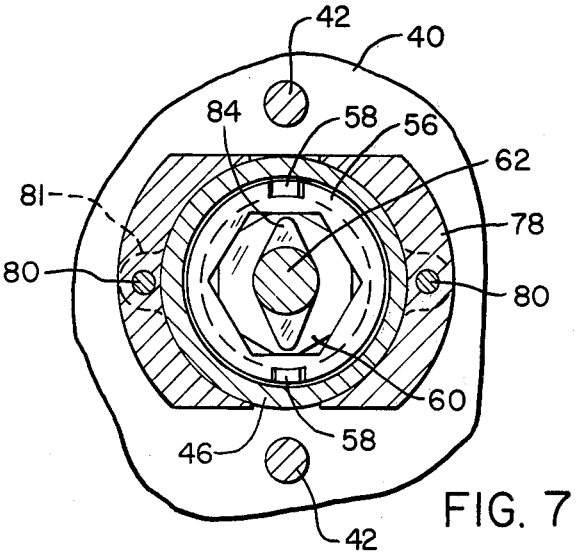
FIG. 7
FIG. 8
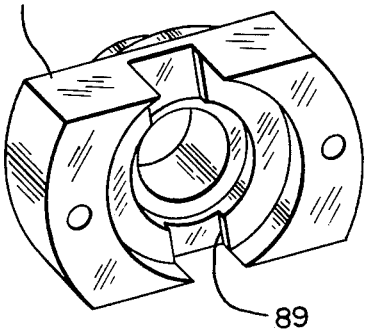

LOCK MECHANISM

BACKGROUND OF THE INVENTION

The present invention relates to a single cylinder deadbolt lock with thumbturn and particularly to such a lock wherein the thumbturn is selectively disengaged according to the manner in which the lock is operated.

Single cylinder deadbolt locks are generally restricted in their application to residences because of security disadvantages. For example, a single cylinder lock with a thumbturn on the inside of the door is easily operated by an intruder to gain exit from the premises for easy removal of stolen merchandise after break-in through some other means such as a window or the like. The only security hardware locking device available for effectively solving this problem has been the double cylinder deadbolt lock. However, this type of lock is not recommended for residential uses simply because of the difficulty entailed in exiting from the locked premises. The double cylinder lock requires the use of a key on the inside of the door to effect exit and therefore its use is not considered advisable because of possible difficulty in locating a key and inserting the key in the lock in an emergency. Thus a conflict exists between usual police and fire department concepts relating to security and easy exit features.

SUMMARY OF THE INVENTION

In accordance with the present invention, a lock mechanism comprises a lock cylinder, a manually engageable knob and a bolt wherein releasably engageable means normally intercouple the cylinder and the knob in operating relation to said bolt. Selectively operable means position the releasably engageable means in non-coupling relation so that the bolt cannot then be operated from said knob.

In accordance with a particular embodiment of the present invention, a single cylinder deadbolt lock includes a cylinder, a locking bar shaft and a thumbturn knob which are normally engaged whereby the cylinder or the thumbturn knob will operate the bolt. Coupling means provided between the bar shaft and the thumbturn are normally engaged in mating relation in a first axial position of the bar shaft. In this first position, the coupling means associated with the bar shaft also meshes with a further rotatable element which is limited in regard to axial movement and frictionally engaged. The cylinder and locking bar shaft may be urged axially and turned to disengage the thumbturn from the bar shaft, and at the same time the coupling means is lifted out of mesh and out of registry with the further rotatable element. The thumbturn and bar shaft are thereby held out of engagement.

According to one embodiment of the present invention, the thumbturn is then adapted to spin freely whereby the lock mechanism cannot be operated by the thumbturn until the cylinder is rotated substantially back to its original position. According to another embodiment, the thumbturn, when disengaged with the locking bar shaft, is also locked or frozen in a given rotational position whereby the same may not be operated.

The locking mechanism according to the present invention enables the occupant of a premises to lock the exterior door by means of a cylinder lock, while selectively disengaging the thumbturn on the inside of the door whereby exit may then not be gained from inside.

Alternatively, the same mechanism may be employed for disengaging the thumbturn while unlocking the door, whereby the thumbturn may not then be operated for locking the premises without a key. The latter alternative also prevents operation of the bolt and closing of the door as would cause damage to the door molding, door and lock mechanism.

The lock mechanism according to the present invention is normally locked and unlocked from inside the door or from outside the door. It can also be locked from the outside and unlocked from the inside or vice-versa. In this manner, the lock mechanism according to the present invention operates to provide the functions of a single cylinder deadbolt lock with thumbturn. It also provides the advantages of a double cylinder deadbolt lock by selectively rendering the mechanism inoperable without a key, thereby providing greater security when a structure is unoccupied since it is then difficult to remove property after unauthorized entry.

It is therefore an object of the present invention to provide an improved single cylinder lock with thumbturn.

Another object of the present invention is to provide an improved locking mechanism which combines the functional features of a single cylinder deadbolt lock with those of a double cylinder deadbolt lock.

It is another object of the present invention to provide an improved lock combining features of security, safety and economy.

It is a further object of the present invention to provide an improved lock having versatility in application to either commercial or residential structures.

It is another object of the present invention to provide an improved deadbolt lock which denies exit to persons who have entered the structure illegally.

It is a further object of the present invention to provide an improved lock having a thumbturn which is selectively disengageable through simple operation of the lock.

The subject matter which we regard as our invention is particularly pointed out and distinctly claimed in the concluding portion of this specification. The invention, however, both as to organization and method of objects thereof, may best be understood by reference to the following description taken in connection with the accompanying drawings wherein like reference characters refer to like elements.

DRAWINGS

FIG. 2 is a partial cross-sectional view of the lock mechanism according to the present invention, illustrating the thumbturn thereof in disengaged position, but ready for immediate engagement upon rotation of the thumbturn;

FIG. 3 is a partial cross-sectional view of the lock mechanism according to the present invention illustrating the thumbturn thereof in its engaged position;

FIG. 4 is a partial vertical cross-sectional view of FIG. 1 mechanism taken at 4—4 in FIG. 1;

FIG. 5 is a partial vertical cross-sectional view of the FIG. 1 mechanism taken at 5—5 in FIG. 1;

FIG. 6 is a partial vertical cross-sectional view of the FIG. 1 mechanism taken at 6—6 in FIG. 1;

FIG. 7 is a partial vertical cross-sectional view of FIG. 1 mechanism taken at 7—7 in FIG. 1;

FIG. 8 is a perspective view of a retainer element of the FIG. 1 mechanism;

DESCRIPTION OF THE PREFERRED EMBODIMENT

Figure 1:
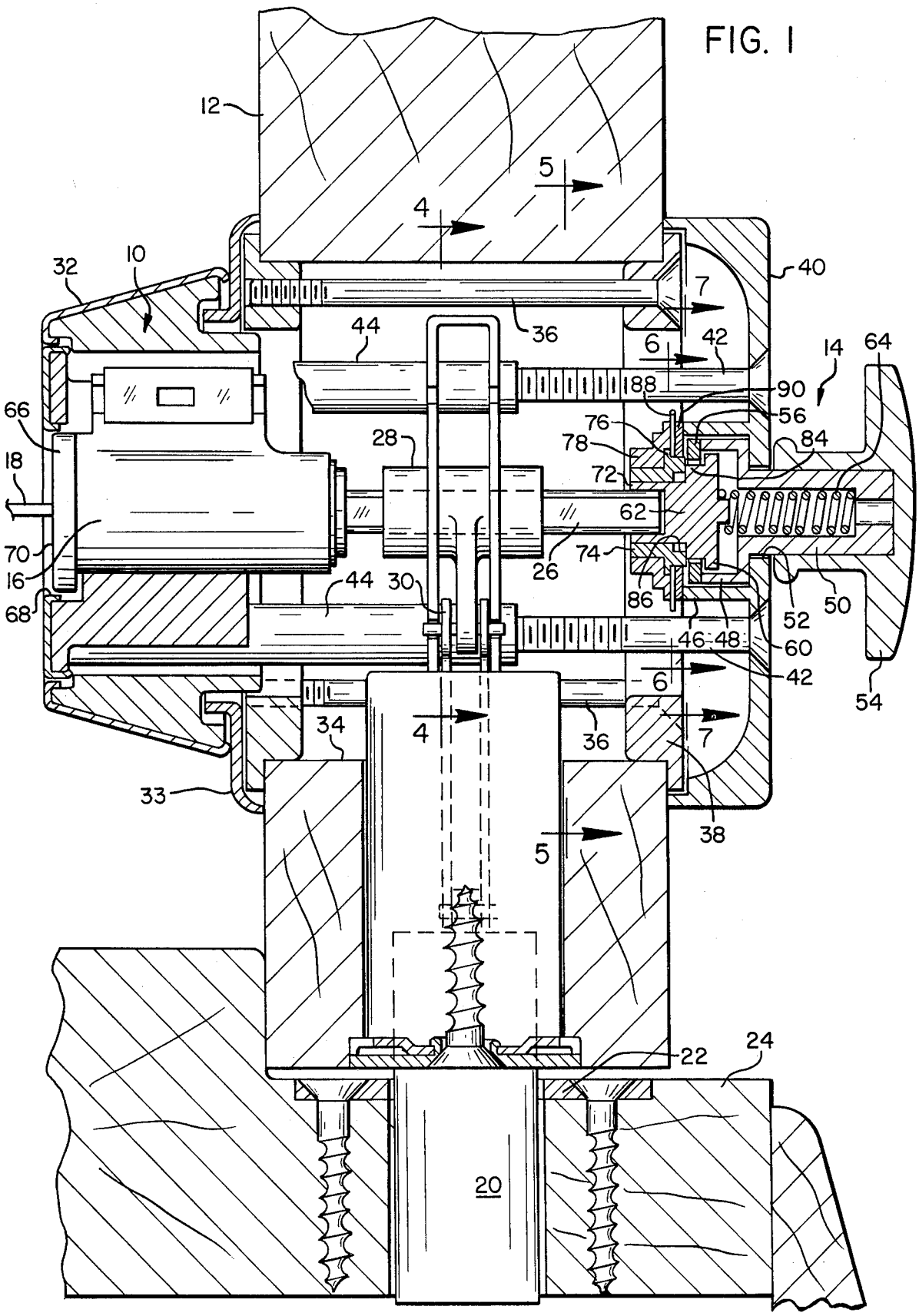
FIG. 1 is a horizontal cross-sectional view through a door and lock mechanism according to the present invention illustrating the thumbturn thereof in disengaged position.

Referring to the drawings and particularly FIGS. 1 through 8, illustrating a lock mechanism according to a first embodiment of the present invention, such lock mechanism includes a cylinder assembly 10 positioned on the exterior side of a door 12 and a thumbturn 14 mounted on the interior side. Either rotation of the lock cylinder 16 by means of key 18, or rotation of thumbturn 14 is normally effective for rotating bolt 20 in and out of locking relationship with plate 22 secured to doorjamb 24. The lock cylinder 16, operable in the usual manner, rotates flat sided locking bar shaft 26, turning crank 28 for operating mechanism 30 for the bolt 20 in the standard manner.

Cylinder assembly 10 is covered by escutcheon 32 mounted over a plate 33 which is secured through the lock receiving aperture 34 in the door by bolts 36 to plate 38 at the inner side of aperture 34. A further cover plate 40 on the interior side of the door receives and supports thumbturn 14, as hereinafter more fully described, and plate 40 is secured in place with bolts 42 which engage threaded extensions 44 secured to the cylinder assembly 10.

The inner wall of plate 40 includes a cylindrical housing 46 within which cylindrical thumbturn body 48 is received, said body having an extension 50 of smaller diameter passing through aperture 52 to which extension the thumbturn knob 54 is secured. On the open end of thumbturn body 48 is secured a gear element 56 which is provided with slots for receiving splines 58 of the thumbturn body. In the illustrated embodiment, the gear element 56 comprises an internal gear in the form of a hexagonal opening for receiving a mating external gear element in the form of an exterior hexagonal configuration. This external gear element comprises an exterior hexagonal surface 60 of hub 62 slidably received at the end of flat sided locking bar shaft 26 whereby rotation of bar 26 rotates hub 62 constitutes coupling means according to the present invention. Under ordinary circumstances, the hub 62, shaft 26 and cylinder 16 are urged to the left as particularly illustrated in FIG. 3 by spring 64 comprising urging means received within extension 50 of the thumbturn body, whereby hexagonal shapes 56 and 60 are in full mating relationship. Thus, rotation of cylinder 16 would operate bolt 20 and also turn the thumbturn knob 54, while rotation of thumbturn knob 54 would similarly rotate the bar and operate the bolt.

In FIG. 1 the cylinder is illustrated as depressed to the right by hand pressure on key 18, the cylinder 16 having an enlarged outer end 66 received within enlarged outer well portion 68 of the axial opening within which cylinder 16 rotates. The larger diameter outer well portion of the axial opening concludes in a shoulder arresting further movement of the cylinder to the right in FIG. 1. In its non-depressed condition, the outer face 70 in FIG. 1 is substantially flush with the outer face of the escutcheon, and is held from moving out of the axial opening by the remainder of the cylinder lock mechanism.

About the lower shank 72 of hub 62 there is slidably received a sleeve 74 having an upper shoulder 76 and held in position against axial movement by a retainer 78 secured with screws 80 to ears 81 on the cylindrical housing 46. Sleeve 74 is restrained to limit axial movement thereof. Under circumstances when gear elements 56 and 60 are in engagement, a diametric tooth 34 on the inner side of hub 62 engages a similarly shaped diametric slot 86 in sleeve 74 constituting a meshing means. The tooth and slot are each characterized by two 180 degree spaced ears on opposite sides of the shaft. Therefore, as appears, shaft 26, hub 62, thumbturn body 48 and sleeve 74 all rotate together under normally engaged conditions. However, if the cylinder 16 is depressed to the right as illustrated in FIG. 1, and rotated, the diametric tooth 84 will be removed from mating slot 86, and the rotation of hub 62 will carry the diametric tooth 84 out of juxtaposed position with slot 86, whereby relaxation of the pressure on key 18 after turning the key will retain mechanism in the state illustrated in FIG. 1. That is, tooth 84 bears on the face of hub 62 by virtue of bias from spring 64. With the diametric tooth 84 out of slot 86, gear elements 56 and 60 are held out of mating relation. Thus elements 56 and 60 comprise releasably engageable means. It will be noted that the engagement of the diametric tooth 84 against the face of sleeve 74 spaces gear elements 56 and 60 entirely out of any touching relation so that the thumbturn may spin freely. Return to the engaged position is achieved by rotating cylinder 16 in a reverse direction by means of key 18 whereby the diametric tooth 84 will fall back into slot 86 as pressure is exerted thereupon by spring 64. When the occupant re-enters the structure, he must re-engage the thumbturn since re-engagement automatically takes place when the lock is unlocked with a key. At first, diametric tooth 84 will become only partially engaged with slot 86, as illustrated in FIG. 2, should the gear elements 56 and 60 not be fully aligned. Then, however, as one seeks to operate the thumbturn by turning knob 54, gear elements 56 and 60 will snap back into the original position as illustrated in FIG. 3, whereby the thumbturn is fully engaged and is capable of operating the mechanism. Elements 84, 86 constitute selectively operable means for positioning the releasably engageable means in non-coupling relation.

To prevent rotation of sleeve 74 with hub 62 when the two are in disengaged relation, a spring 88 is provided which bears upon sleeve 74 adjacent shoulder 76. The spring is located between retainer 78 and a washer 90 which spaces spring 88 from cylindrical housing 46. The spring is received within a slot 89 in retainer 78. (See FIG. 8.) This spring provides drag on sleeve 74 behind shoulder 76 whereby the sleeve retains a given non-rotational condition when its slot 86 is not engaged by diametric tooth 84 so that the two may later be returned to engaging relation by reverse operation of the mechansim.

It is seen that the thumbturn may be disengaged in either the locked or unlocked condition. Thus, if the door is unlocked, and the party leaving the premises desires to lock the door and disengage the thumbturn, he may lock the door while depressing the lock cylinder inwardly with the key, thereby causing diametric tooth 84 to ride up upon sleeve 74 whereby gear elements 58 and 60 are no longer engaged. Spring 64 presses the diametric tooth 84 against the face of sleeve 74, but there is no such engagement, frictional or otherwise, between the gear elements 56 and 60 whereby the thumbturn spins freely, and no attempt at unlocking the door from the inside by rotating the thumbturn will be successful.

On the other hand, if the door is locked in a mode in which the thumbturn remains engaged, and it is desired to unlock the door while disengaging the thumbturn, the cylinder 16 is rotated while depressing the key whereby diametric tooth 84 rides up out of slot 86 causing such disengagement. Thereafter, the door may not be locked by the thumbturn until the cylinder is rotated once more.

As hereinbefore indicated, the disengaging of the thumbturn with the door locked provides the security feature of preventing the convenient removal of stolen items of large size after a break-in to the premises via means other than the locked door. Disengagement of the thumbturn with the door in unlocked condition is advantageous for places of business where unintended locking of the door by the thumbturn is not desired.

Figure 9:
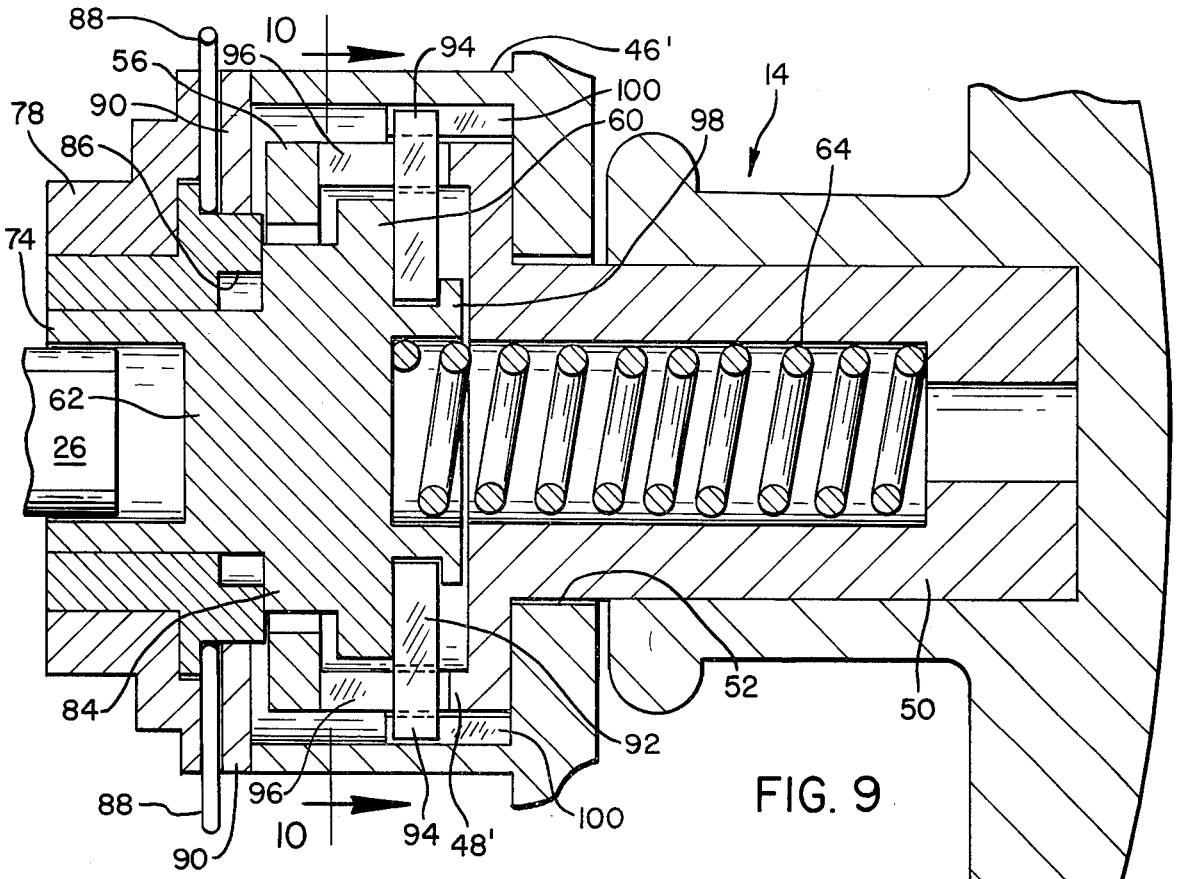
FIG. 9 is a horizontal cross-sectional view of a lock mechanism according to an alternative embodiment of the present invention illustrating the thumbturn thereof in disengaged position with the remainder of the lock mechanism.
Figure 10:
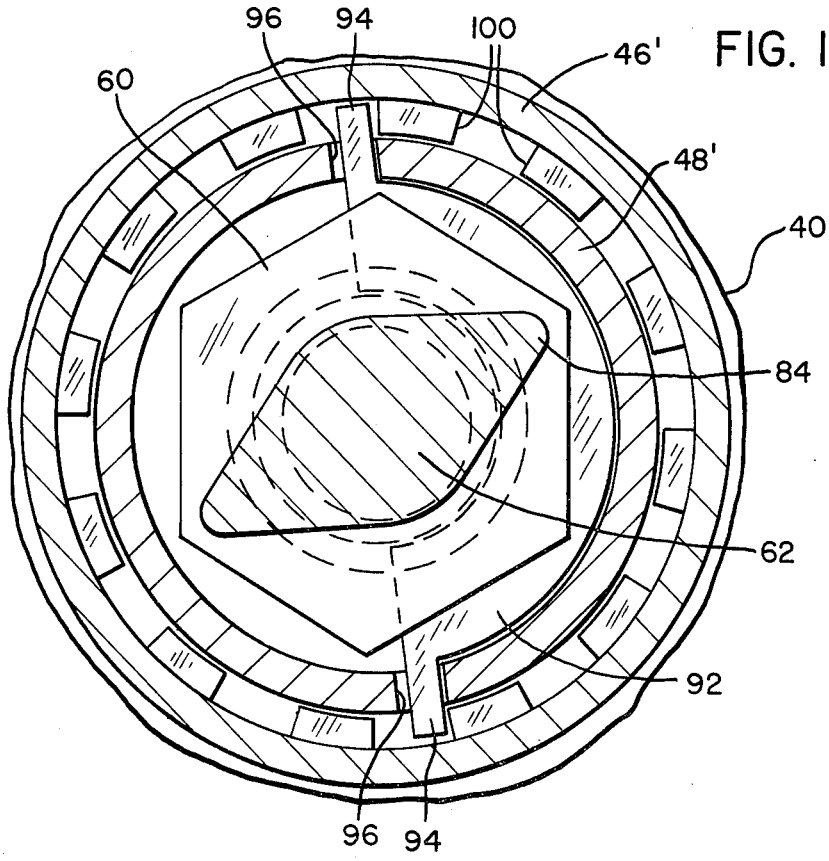
FIG. 10 is a vertical cross-sectional view of the FIG. 9 mechanism taken at 10—10 in FIG. 9.

The previous embodiment relates to rendering the thumbturn on the interior side of the door freespinning in response to the manner in which the door is locked (or unlocked). In accordance with the following embodiment, the thumbturn is similarly rendered ineffective, but in this case is "frozen" into a non-operative condition. Referring to FIGS. 9 and 10 it will be observed the mechanism is substantially the same in regard to movement of hub 62 by rotation of the locking mechanism for moving diametric tooth 84 up out of slot 86 thereby disengaging the gear elements 56 and 60 so the thumbturn will not operate the lock. However, an additional element 92 as included in the form of a split washer provided with end tabs 94 which normally rotate freely within cylindrical housing 46', these tabs extending through slots 96 in thumbturn body 48' wherein overlapping shoulder 98 on the end of hub 62 holds the washer 92 in place. However, the cylindrical housing 46' is provided with a plurality of splines 100 adapted to receive the tabs 94 when the locking bar shaft 26 is urged against the spring bias, and thus not only are gear elements 56 and 60 disengaged but also the thumbturn is caused to engage splines whereby to prevent rotation thereof.

In the illustrated embodiments, the locking bar shaft is moved axially in response to pressure against the locking cylinder exerted upon the key by the individual locking or unlocking the door. However, it is clear other mechanisms may be employed for shifting the mechanism according to the present invention from a first axial position to a second axial position. For example, the lock cylinder may be stationary with the locking bar shaft being moved axially by a key of extended length which is utilized when it is desired to disengage the thumbturn.

While we have shown and described several embodiments of our invention, it will be apparent to those skilled in the art that many changes and modifications may be made without departing from our invention in its broader aspects. We therefore intend the appended claims to cover all such changes and modifications as fall within the true spirit and scope of our invention.

We claim:

1. A lock mechanism having a forward end and a reverse end, said mechanism comprising a lock cylinder at the forward end thereof, a manually engageable knob on the reverse end of the lock mechanism for positioning on the opposite side of a door from said cylinder, and a bolt operated by rotation of said cylinder, releasably engageable means normally intercoupling both said cylinder and said knob in operating relation to said bolt, and means selectively operable from said forward end of said lock mechanism for positioning said releasably engageable means in non-coupling relation so that said bolt cannot be operated from said knob while maintaining said cylinder in operable relationship with said bolt.

2. A lock mechanism having a forward end and a reverse end, said mechanism including a lock cylinder at the forward end thereof, a manually engageable knob on the reverse end of the lock mechanism for positioning on the opposite side of a door from said cylinder, said knob being connected to said cylinder by a locking bar means, and a bolt operated by said locking bar means by rotation of said cylinder , wherein the improvement comprises:

coupling means located between said locking bar means and said manually engageable knob for normally engaging said locking bar means and said knob in mating relationship in a first axial position of said coupling means so that said bolt is also operable by said knob, and meshing means for holding said coupling means in a second axial position out of said mating relationship upon axial depression and rotation of said cylinder to place said meshing means in non-meshing relationship so that said bolt is operable only by said cylinder.

3. The lock mechanism according to claim 2 including biasing means for normally urging said coupling means into releasably engageable relation with said meshing means, said meshing means being restricted in axial movement and impeded with respect to rotational movement, so that depression and rotation of said cylinder moves said coupling means into non-meshing relation biased against a side of said meshing means.

4. A lock mechanism having a forward end and a reverse end, said mechanism including a lock cylinder at the forward end thereof, a manually engageable knob on the reverse end of the lock mechanism connected to said cylinder by a locking bar means and a bolt operated by said locking bar means by rotation of said cylinder, wherein the improvement comprises:

coupling means rotatable with said locking bar means and located between said locking bar means and said manually engageable knob for normally matingly engaging said manually engageable knob in a first axial position of said locking bar means so that the bolt is also operable by said knob, wherein depressed axial movement of said locking bar means releases the mating relationship between said coupling means and said manually engageable knob so that said bolt is operable only by said cylinder, meshing means for also normally matingly engaging said coupling means in interleaved relationship in the first axial position of said locking bar means, wherein depression of said locking bar means to a second axial position and rotation thereof disengages said meshing means to establish a non-meshing relationship for holding said coupling means in a second axial position, and means for normally urging said coupling means toward said first axial position.

5. The lock mechanism according to claim 4 wherein said means for urging said coupling means toward said first axial position causes non-meshing abutting engagement of said coupling means and meshing means in said second axial position, said coupling means and said manually engageable knob being completely out of mating relationship in said second axial position.

6. A lock mechanism having a forward end and a reverse end, said mechanism including a lock cylinder at the forward end thereof, a manually engageable knob on the reverse end of the lock mechanism connected to said cylinder by a locking bar shaft and a bolt normally operated via said locking bar shaft by rotation of said cylinder or said knob, wherein the improvement comprises:

a hub rotatable with and movable axially with movement of said locking bar shaft, said hub normally having a matingly engageable relationship with said knob in a normal axial position of said locking bar shaft, and a rotatable sleeve coaxial with said locking bar shaft, said hub normally being urged into mating relationship therewith, said hub being movable axially in response to axial movement of said locking bar shaft and rotatable out of mating relationship with said sleeve to a second non-mating position in which said hub is held out of mating relationship with said knob by said sleeve.

7. The lock mechanism according to claim 6 further including means associated with said hub for locking said manually engageable knob when said hub is held in said second position.

8. The lock mechanism according to claim 7 wherein said means associated with said hub comprises a washer moveable axially with said hub and coaxial with said locking bar shaft including a tab engaging said knob and normally freely rotatable with respect to said hub, and a splined housing surrounding said washer engageable by said tab with said hub in its second position.

9. The lock mechanism according to claim 6 further including friction means for impeding rotation of said sleeve and means for restraining said sleeve against axial movement.

10. The lock mechanism according to claim 6 wherein said hub is provided with external gear means and wherein said manually engageable knob is provided with an axial recess for receiving said external gear means of said hub, the opening of said recess having internal gear means for engaging the external gear means of said hub with said hub in a normal position to provide said matingly engageable relationship.

11. The lock mechanism according to claim 10 wherein said hub includes a single diametric tooth and wherein said sleeve is provided with a diametric slot for receiving said tooth in a normal axial position, said tooth abutting said sleeve out of registry with said slot to provide said non-mating position.

12. The lock according to claim 6 wherein said manually engageable knob includes an axial recess, and further including a spring received within said recess for urging said hub toward said sleeve.

13. The lock according to claim 6 wherein said locking bar shaft is axially movable in response to axial movement of said cylinder.

* * * * *

UNITED STATES PATENT AND TRADEMARK OFFICE

CERTIFICATE OF CORRECTION

PATENT NO. : 4,047,408

DATED : September 13, 1977

INVENTOR(S) : EDDIE D. JOHNS, ET AL

It is certified that error appears in the above-identified patent and that said Letters Patent are hereby corrected as shown below:

Column 3, line 51, after "hub 62" insert --. Hub 62--.

Column 4, line 11, "34" should be --84--.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*